United States Patent [19]

Klein

[11] Patent Number: 4,770,300

[45] Date of Patent: Sep. 13, 1988

[54] STACKABLE AND NESTABLE BASKET

[75] Inventor: Max S. Klein, West Bloomfield Twp., Mich.

[73] Assignee: Sevko, Deerfield, Ill.

[21] Appl. No.: 3,373

[22] Filed: Jan. 14, 1987

[51] Int. Cl.[4] ..... B65D 21/04

[52] U.S. Cl. ..... 206/506

[58] Field of Search ..... 206/505, 506, 507

[56] References Cited

U.S. PATENT DOCUMENTS

| | | | |
|---|---|---|---|
| 2,029,746 | 2/1936 | Tufts et al. . | |
| 2,641,383 | 6/1953 | Coursey . | |
| 3,375,953 | 4/1968 | Miller, Jr. . | |
| 3,379,339 | 4/1968 | Aserbauer | 206/506 |
| 3,421,656 | 1/1969 | Asenbauer . | |
| 3,443,722 | 5/1969 | Cloyd | 206/507 |
| 3,458,082 | 7/1969 | Drader . | |
| 3,648,909 | 3/1972 | Wisecarver . | |
| 3,659,743 | 5/1972 | Box . | |
| 3,752,352 | 8/1973 | Senecal . | |
| 4,040,517 | 8/1977 | Torokvel . | |
| 4,105,117 | 8/1978 | Atkin et al. . | |
| 4,391,369 | 7/1983 | Stahl et al. . | |

FOREIGN PATENT DOCUMENTS

| | | | |
|---|---|---|---|
| 1131652 | 2/1957 | France . | |
| 1252816 | 12/1960 | France | 206/506 |
| 1467165 | 12/1966 | France | 206/507 |
| 2103182 | 2/1983 | United Kingdom | 206/506 |
| 2142305 | 1/1985 | United Kingdom | 206/506 |

*Primary Examiner*—George E. Lowrance

*Attorney, Agent, or Firm*—Basile and Hanlon

[57] ABSTRACT

A stackable and nestable basket including a basket having a bottom, two opposing sides, two opposite ends, and an open top. The sides and ends are angled inwardly from a top edge toward the bottom. A ledge is formed on the top edge of the sides and ends and extends outwardly from the top edge terminating in an outer ledge edge. The basket also includes a pair of handles movable into a carrying position, a nesting position, and a stacking position. Each of the pair of handles is mounted to each of the sides of the basket, so that the handles are pivotable into a carrying position, wherein the pair of handles contact each other above the ledge to form a single carrying handle.

10 Claims, 4 Drawing Sheets

STACKABLE AND NESTABLE BASKET

BACKGROUND OF THE INVENTION

1. Field of the Invention

The invention relates to baskets which can be stacked on top of one another and nested within each other, more particularly to baskets having these characteristics by means of handles which can be pivoted and/or slid with relation to the sides of the basket.

2. Description of the Prior Art

Stacking and nesting containers are generally known in the art. For examples, see U.S. Pat. Nos. 4,391,369; 4,105,117; 2,641,383; 3,752,352; 3,379,339; 2,029,746; 3,375,953; 3,659,743; 3,648,909; 3,458,082; 3,421,656; 4,040,517; and France Pat. No. 1,131,652. These patents generally relate to containers having pivotable bales movable into a first position for stacking and into a second position for nesting. Some of the other patents disclose containers having support member slidable within slots in the upper portion of the containers between a first position for stacking and a second position for nesting with similar containers.

SUMMARY OF THE INVENTION

The present invention is a stackable and nestable basket having a bottom, two opposing sides, two opposing ends, and an open top. The sides and ends of the basket are angled inwardly from a top edge toward the bottom. The top edge has a ledge extending outwardly from the sides and the ends. Handle means for pivoting into a carrying position, a stacking position, and a nesting position are provided. The handle means includes a pair of handles mounted to each of the opposite sides of the basket, and are pivotable into a carrying position, wherein the pair of handles contact each other above the ledge to form a single carrying handle. The handles are also movable into a stacking position and a nesting position in cooperation with other similar baskets.

It is a desirable characteristic of the present invention to have handles which can be orientated in an upward angular position to affect a single handle in a carrying position for grasping while moving the basket, and to provide handles which are mounted such that the handles can be orientated in a nesting position and in a stacking position in cooperation with other similar baskets.

BRIEF DESCRIPTION OF THE DRAWINGS

In the drawings like reference numerals refer to similar elements throughout the various views.

DESCRIPTION OF THE PREFERRED EMBODIMENTS

Figure 1:
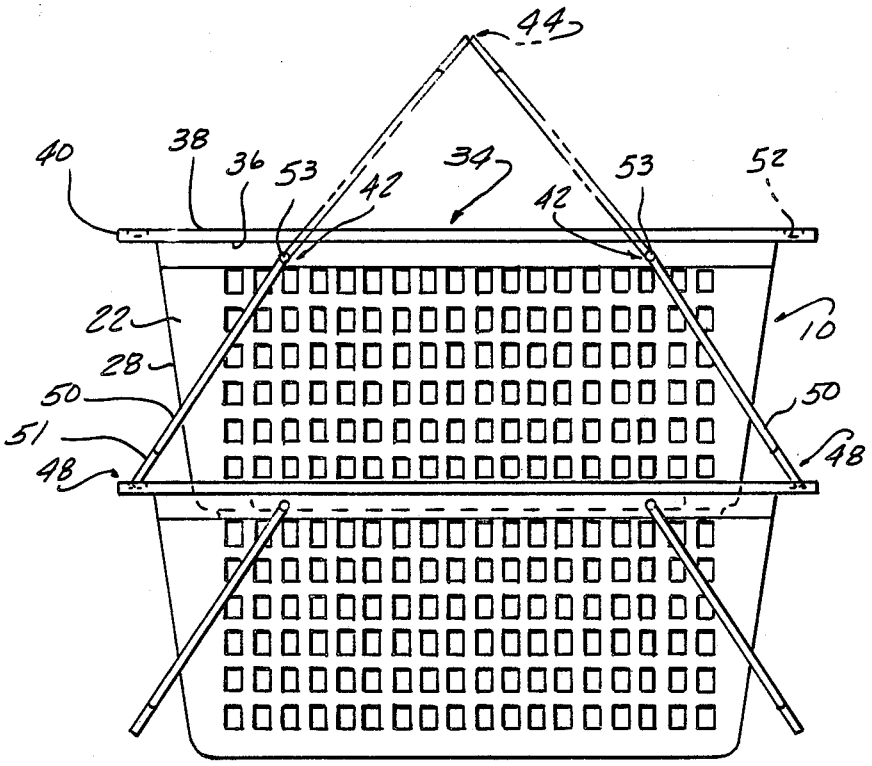
FIG. 1 is a side view of a first embodiment showing two baskets in a stacking orientation.

The present invention is a basket 10 which has a bottom 12 with an interior bottom surface, an exterior bottom surface, a bottom length, and a bottom width. The basket also has two opposing sides 22, preferably formed integrally with the bottom 12. Each of the sides has an interior side surface and an exterior side surface. The basket 10 also has two opposing ends 28, each of the ends has an interior end surface and an exterior end surface and preferably are formed integrally with the bottom 12 and the two opposing sides 22 to define an open top 34 of the basket 10. The sides 22 and the ends 28 are angled inwardly from a top edge 36 toward the bottom 12. A ledge 38 preferably formed integrally with the top edge 36 of the sides 22 and the ends 28, extends outwardly from the top edge 36 terminating at an outer ledge edge 40. The basket 10 is provided with handle means 42 for orientating a pair of handles 50 into a carrying position 44, a nesting position 46, and a stacking position 48. Each of the pair of handles 50 is mounted to each of the sides 22 of the basket 10 and are pivotable into a carrying position 44 with the pair of handles 50 contacting each other above the ledge 38 to form a single carrying handle.

Figure 2:
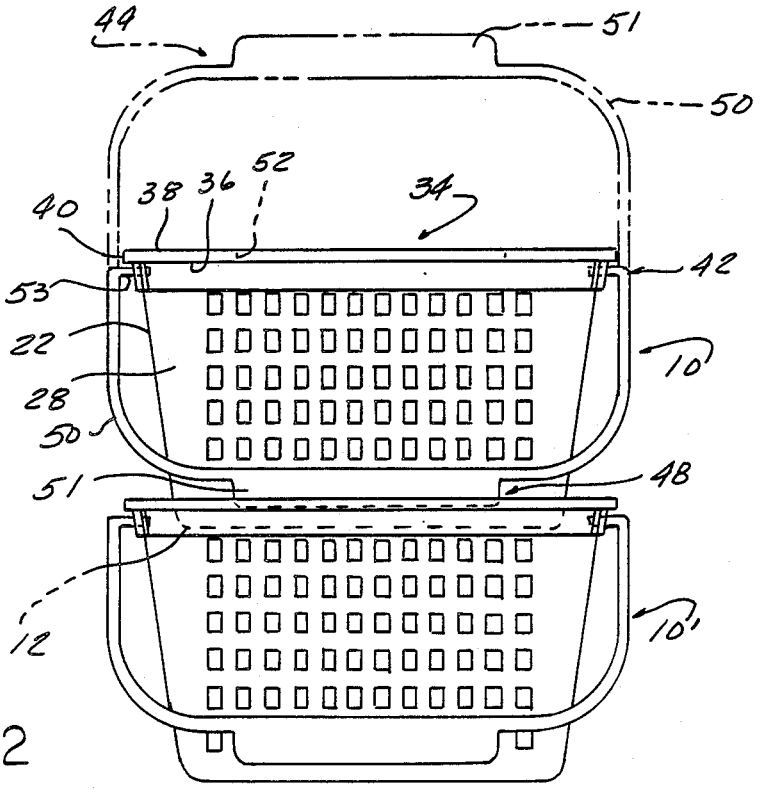
FIG. 2 is an end view of the first embodiment shown in a stacking orientation as indicated in FIG. 1.
Figure 3:
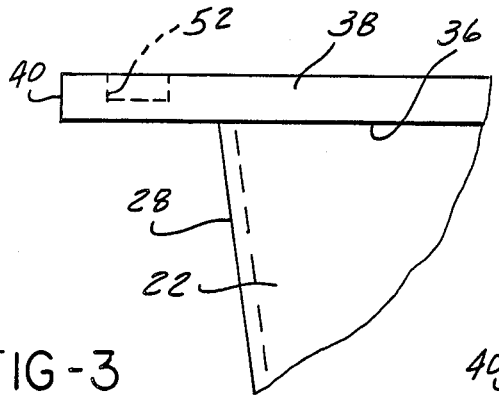
FIG. 3 is a side detail showing a groove in a ledge of the first embodiment of the basket engagable with a handle.

A first embodiment of the basket 10 is shown in FIG. 1 through FIG. 3. As can best be seen in FIGS. 1 and 2, the handle means 42 are pivotable into a stacking position 48, with the pair of handles 50 oriented in a downward angular position below the ledge 38. A groove 52 is formed in the ledge 38 at each of the ends 28 of the basket 10. The pair of handles 50 have extensions 51 which are matingly disposed within the groove 52 in the ledge 38 at each of the ends 28 of a similar second basket 10' to accomplish stacking of a plurality of baskets. Also, the pair of handles 50 are pivotable into a nesting position 46 with the pair of handles 50 oriented beyond the ledge 38 at each of the ends 28 of a similar second basket 10', allowing a plurality of baskets to nest within each other (now shown). The handle means 42 are pivotally attached to the basket 10 by a pin 53 connection extending inwardly from the handle through the sides 22, with the pair of handles 50 disposed externally to the sides 22 and the ends 28 of the basket 10.

Figure 3A:
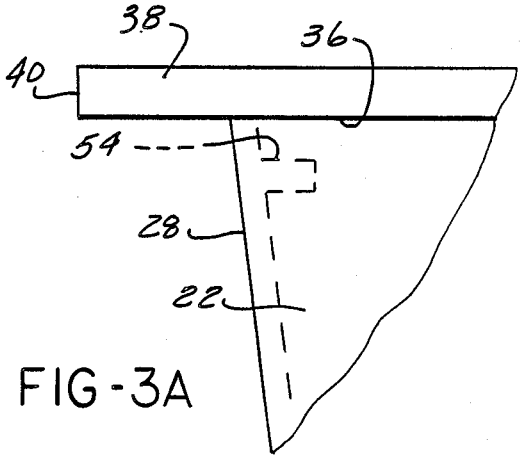
FIG. 3*a* is an alternative side detail showing an alternative embodiment wherein the groove is replaced with an inner ledge engagable with the handles.

FIG. 3*a* shows an alternative to the first embodiment, wherein the groove 52 in the ledge 38 is replaced with an inner ledge 54 extending outwardly from the interior end surface of each of the ends 28, and which is preferably formed intergrally with the ends 28 of the basket 10. In this alternative, the extensions 51 of the pair of handles 50 matingly engage the inner ledge 54 adjacent to the interior end surface while the pair of handles 50 are in the stacking position 48. The pair of handles 50 are oriented beyond the ledge 38 while in the nesting position 46 to allow a plurality of baskets to nest within each other.

Figure 4:
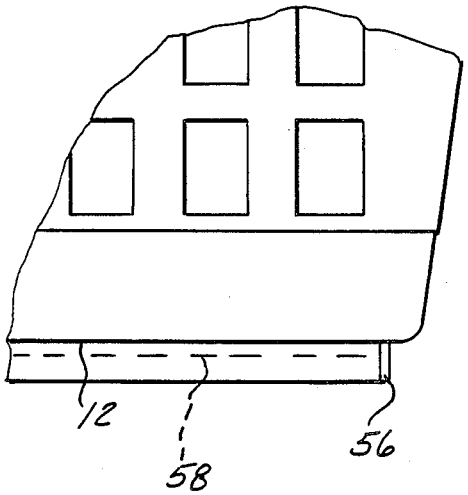
FIG. 4 is a side detail of the bottom of the basket.
Figure 5:
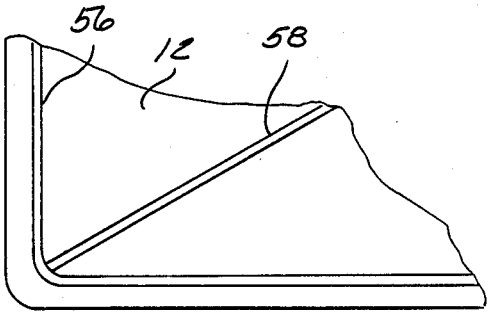
FIG. 5 is a bottom detail of the bottom of the basket.

To increase the strength of the bottom 12 of the basket 10, a lip 56 can be formed intergrally with the basket 10 which extends downwardly from the exterior bottom surface around the peripheral edge of the bottom 12 as shown in FIGS. 4 and 5. In addition, a plurality of bottom support struts 58 can be formed intergrally on the bottom 12 of the basket 10 extending downwardly from the exterior bottom surface interconnecting with the lip 56 to further increase the rigidity of the bottom 12.

Figure 6:
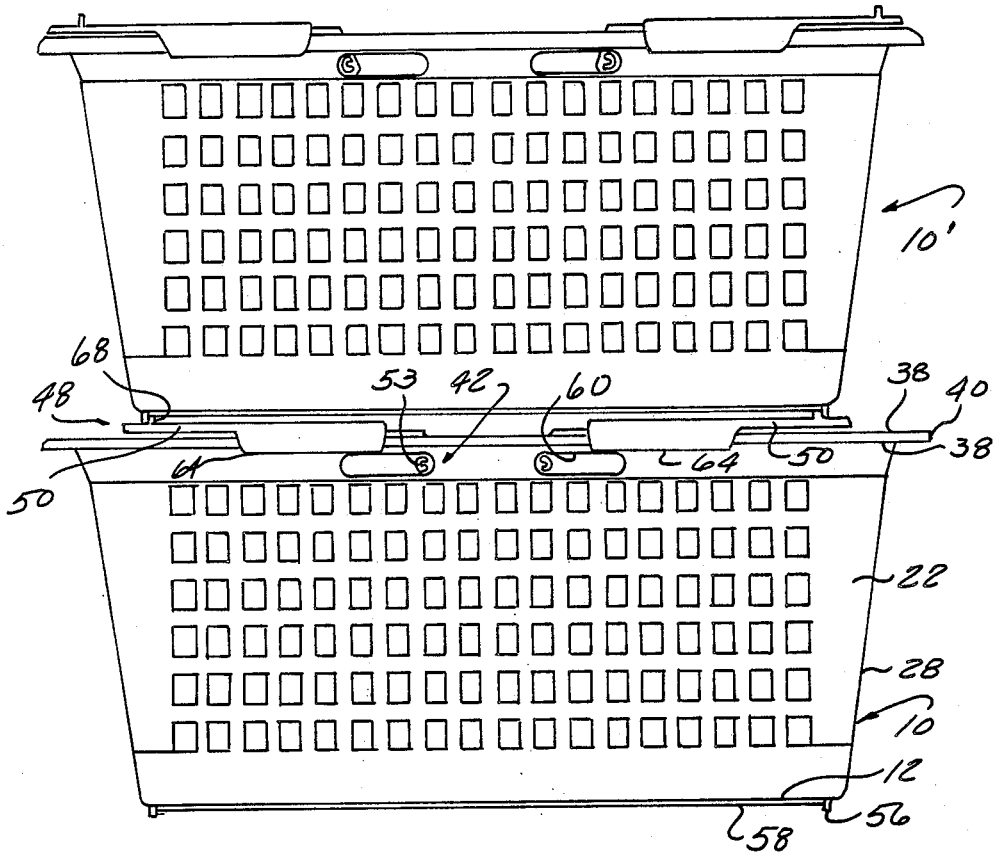
FIG. 6 is a side view of a second embodiment of the basket showing one basket stacked on top of another.
Figure 7:
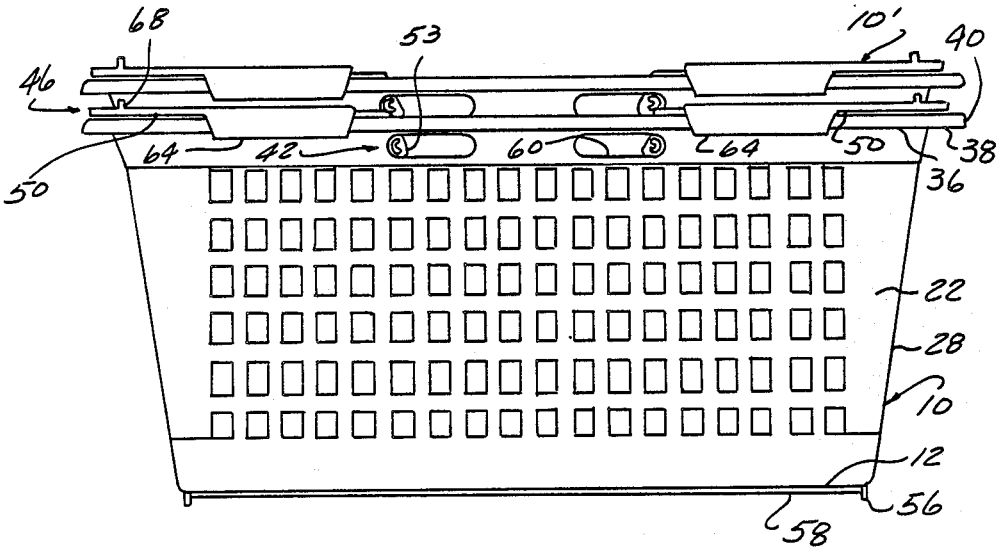
FIG. 7 is another side view of the second embodiment of the basket showing one basket nested within another.
Figure 8:
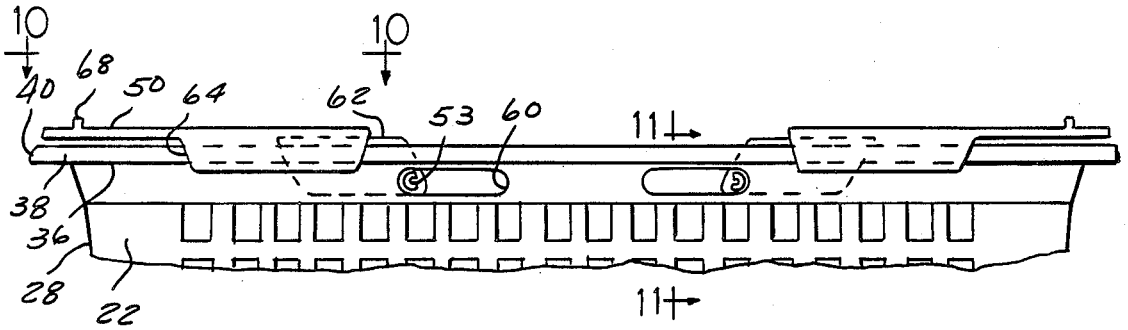
FIG. 8 is a side detail showing the handles of the second embodiment in their nested position.
Figure 9:
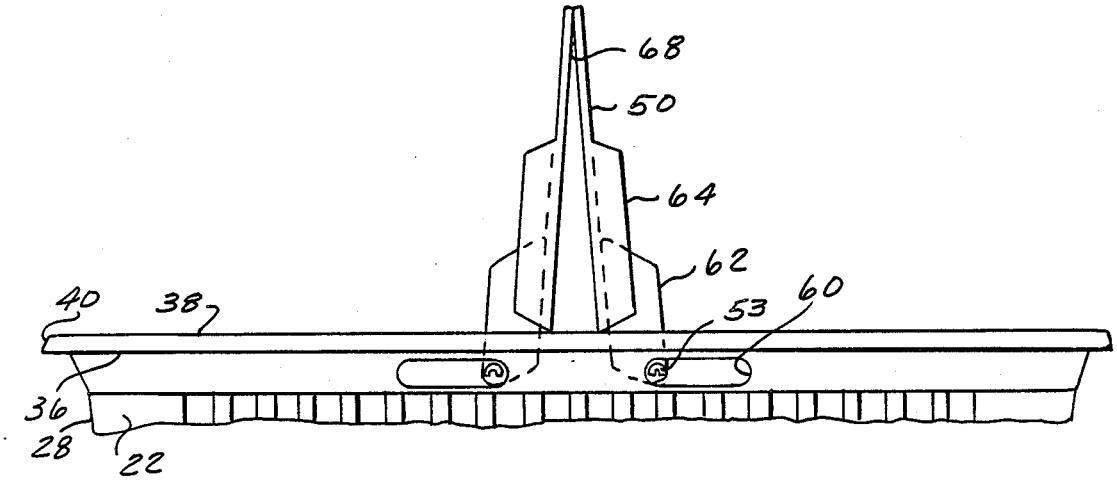
FIG. 9 is a side detail of the handles of the second embodiment in their carrying position.
Figure 10:
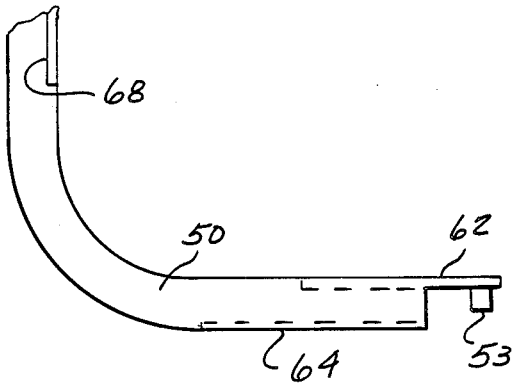
FIG. 10 is a partial top view of the handle of the second embodiment.
Figure 11:
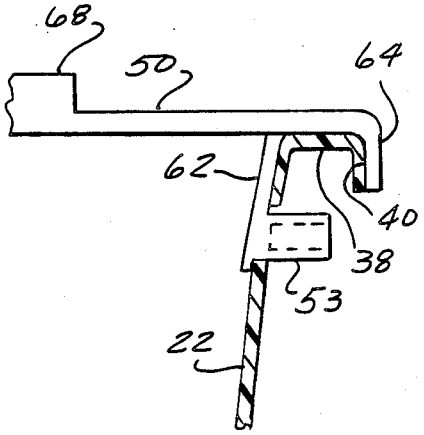
FIG. 11 is a partial sectional side view of the handle of the second embodiment showing its engagement with the basket.

Another embodiment of the present invention, shown in FIG. 6 through FIG. 11, includes handle means 42 with a pair of handles 50 engaged within a pair of slots 60 in each of the opposing sides 22 adjacent to the top edge 36. Each of the pair of handles 50 has a first downwardly extending flange 62 adjacent the interior surface of each of the sides 22, and a second downwardly extending flange 64 adjacent to the outer ledge edge 40 on each of the sides 22. These two downwardly extending flanges, 62 and 64 respectively, define a guide means for sliding movement of the pair of handles 50 on top of the ledge 38 and within the slots 60. The pair of handles 50 are engaged within the slots 60 by an outwardly extending pin 53 from the first downwardly extending flange 62. The pair of handles 50 can be moved into a stacking position 48, as shown in FIG. 6, with the pair of handles 50 disposed in the slots 60 with the outwardly extending pin 53 orientated in the innermost position of the slot 60, whereby the handles 50 span the open top 34 of the basket 10 from each of the sides 22 at a distance relative to each other less than the length of the bottom 12 of a second similar basket 10'. The pair of handles 50 can be slidingly moved outward to the nesting position 46, as shown in FIG. 7, with the pair of handles 50 disposed in the slots 60 to overlay the ledge 38 on each of the ends 28 of the basket 10 allowing a plurality of baskets to nest within each other. FIG. 8 shows a more detailed side view of the pair of handles 50 in the nesting position 46. The outwardly extending pin 53 from the downwardly extending flange 62 is in the outermost position of the slot 60 while in the nesting position 46. The pair of handles 50 can be slidingly moved to the inner position of the slot 60 and pivoted upward until the pair of handles 50 contact each other to form a single handle for carrying, also referred to as the carrying position 44, as shown in FIG. 9. FIG. 10 and FIG. 11 are partial views showing the details of the pair of handles 50. Another embodiment, includes an upwardly extending flange 68 from the pair of handles 50, shown in FIGS. 10 and 11, to secure a second similar basket 10' in the stacking position 48 on top of the pair of handles 50, as shown in FIG. 6, by engaging the bottom 12 adjacent to the lip 56 of the basket 10.

The basket 10 of the present invention can be constructed of any rigid material preferably the bottom 12, sides 22, ends 28, and ledge 38 are integrally formed of a plastic material with either solid sides and ends, or with open mesh construction for the sides 22 and ends 28. The pair of handles 50 are formed separately from a rigid material, preferably a plastic material.

What is claimed is:

1. A stackable and nestable basket capable of moving from a first carrying position, to a second nesting position, and to a third stacking position, said basket comprising:

a container having opposed ends and sides, an open top, and a bottom, said bottom having a smaller length and width than the respective length and width of said top;

a pair of handles pivotally mounted at fixed locations on an outside face of the opposed sides of said basket adjacent the top thereof and displaced inwardly from the ends thereof for pivoting movement above and below the top of the basket wherein said handles pivot outwardly beyond said ends of said basket; and means for supporting said basket in a stacked relationship on at least one other such basket, wherein the first position is formed by pivoting the handles toward each other into an adjacent relationship, the second position is formed by pivoting the handles away from each other, and the third position is formed by cooperation of the means of support and an angled downwardly and outwardly extending position of the handles forming an angle of less than 90° with the respect to the top of the basket.

2. The basket of claim 1 wherein the support means comprises:

a ledge formed on a top edge on each end and projecting outwardly therefrom; and a grove formed in an upper surface of each ledge for engagement with one of the pair of handles when said handles are disposed in the third position.

3. The basket of claim 2 wherein the support means further comprises an extension formed on each of the pair of handles which cooperates with the corresponding groove.

4. The basket of claim 1 wherein the support means comprises:

a ledge formed adjacent a top edge of each end and projecting inwardly therefrom which abuts one of the pair of handles when said pair of handles is in the third position.

5. The basket of claim 4 wherein the support means further comprises an extension formed on each handle for abutment with an upper surface of the corresponding inwardly projecting ledge when said pair of handles is in the third position.

6. A stackable and nestable basket capable of moving from a first carrying position, to a second nesting position, and to a third stacking position, said basket comprising:

a container having opposed ends and sides, an open top, and a bottom, said bottom having a smaller length and width than the corresponding length and width of said top;

means forming a slot disposed in each side and spaced slightly downwardly from a top edge of each side and parallel thereto at two locations thereon slightly displaced toward each end from a center of each side;

a pair of handles having ends pivotally and slidingly mounted within opposing slots; and means for supporting said basket in a stacked relationship on at least one other such basket, wherein the first position is formed by sliding the pair of handles towards each other within the slots and pivoting the handles towards each other into adjacent relationship, the second position is formed by sliding the handles away from each other within the slots and pivoting them away from each other, and the third position is formed by sliding the pair of handles toward each other within the slots and pivoting the handles away from each other into a horizontal position wherein the handles overlay part of the top of the basket.

7. The basket of claim 6 further comprising a pair of downwardly extending flanges formed on each side of each of the pair of handles at a point adjacent the pivotal mounting thereof, the pair of flanges being formed on the inside surface and outside surface of the handle in a spaced apart relationship for engagement with the top edge of each side of the container when the handles are in the third position.

8. The basket of claim 6 wherein the support means comprises:

a downwardly extending lip formed on the bottom of the basket adjacent a peripheral edge thereof; and an upwardly extending flange formed on each of said pair of handles for engagement with the downwardly extending lip to secure the at least one other basket in the stacking position therewith.

9. A stackable and nestable basket capable of moving from a first carrying position, to a second nesting position, and to a third stacking position, said basket comprising:

a container having opposed ends and sides, an opened top, and a bottom, said bottom having a smaller length and width than the respective length and width of said top;

a pair of handles pivotally mounted at fixed locations on an outside face of the opposed sides of said basket adjacent the top thereof;

a ledge formed on a top edge on each end projecting outwardly therefrom;

a groove formed in an upper surface of each ledge for engagement with one of the pair of handles when said handles are disposed in the third position; and an extension formed on each of the pair of handles which cooperates with the corresponding groove, wherein the first position is formed by pivoting the handles toward each other into an adjacent relationship, the second position is formed by pivoting the handles away from each other, and the third position is formed by engagement of the extensions in the grooves when the handles are in an angled, downwardly and outwardly extending position forming an angle of less than 90° with the respect to the top of the basket.

10. A stackable and nestable basket capable of moving from a first carrying position, to a second nesting position, and to a third stacking position, said basket comprising:

a container having opposed ends and sides, an open top, and a bottom, said bottom having a smaller length and width than the corresponding length and width of said top;

means forming a slot disposed in each side;

a pair of handles pivotally and slidingly mounted within said opposing slots; and a pair of downwardly extending flanges formed on each side of each of the pair of handles at a point adjacent the pivotal mounting thereof, the pair of flanges being formed on the inside surface and outside surface of the handle in a spaced apart relationship for engagement with the top edge of each side of the container when the handles are in the third position, wherein the first position is formed by sliding the pair of handles towards each other within the slots and pivoting the handles toward each other into adjacent relationship, the second position is formed by sliding the handles away from each other within the slots and pivoting the handles away from each other, and the third position is formed by sliding the pair of handles toward each other within the slots and pivoting the handles away from each other into a horizontal position wherein the flanges engage the top of the basket.

* * * * *